US007386142B2

(12) United States Patent
Kindred

(10) Patent No.: US 7,386,142 B2
(45) Date of Patent: Jun. 10, 2008

(54) METHOD AND APPARATUS FOR A HEARING ASSISTANCE SYSTEM WITH ADAPTIVE BULK DELAY

(75) Inventor: Jon S. Kindred, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 314 days.

(21) Appl. No.: 10/854,922

(22) Filed: May 27, 2004

(65) Prior Publication Data

US 2005/0265568 A1 Dec. 1, 2005

(51) Int. Cl.
*H04R 25/00* (2006.01)

(52) U.S. Cl. ..... 381/318; 381/83; 381/93

(58) Field of Classification Search ..... 381/60, 381/71.11, 71.12, 83, 93, 94.1, 107, 108, 381/312, 317, 318, 320, 321; 379/388.07; 600/559; 73/585

See application file for complete search history.

(56) References Cited

U.S. PATENT DOCUMENTS

| | | | |
|---|---|---|---|
| 3,601,549 | A | 8/1971 | Mitchell |
| 3,803,357 | A | 4/1974 | Sacks |
| 3,995,124 | A | 11/1976 | Gabr |
| 4,025,721 | A | 5/1977 | Graupe et al. |
| 4,038,536 | A | 7/1977 | Feintuch |
| 4,052,559 | A | 10/1977 | Paul et al. |
| 4,088,834 | A | 5/1978 | Thurmond |
| 4,122,303 | A | 10/1978 | Chaplin et al. |
| 4,130,726 | A | 12/1978 | Kates et al. |
| 4,131,760 | A | 12/1978 | Christensen et al. |
| 4,185,168 | A | 1/1980 | Graupe et al. |
| 4,187,413 | A | 2/1980 | Moser |
| 4,188,667 | A | 2/1980 | Graupe et al. |
| 4,232,192 | A | 11/1980 | Beex |
| 4,238,746 | A | 12/1980 | McCool et al. |
| 4,243,935 | A | 1/1981 | McCool et al. |
| 4,366,349 | A | 12/1982 | Adelman |
| 4,377,793 | A | 3/1983 | Horna |
| 4,425,481 | A | 1/1984 | Mansgold et al. |
| 4,471,171 | A | 9/1984 | Kopke et al. |
| 4,485,272 | A | 11/1984 | Duong et al. |

(Continued)

FOREIGN PATENT DOCUMENTS

| | | |
|---|---|---|
| CH | 653508 | 12/1985 |
| GB | 1356645 | 6/1974 |
| JP | 59-64994 | 4/1984 |
| JP | 60-31315 | 2/1985 |

OTHER PUBLICATIONS

Pau Embree, 'C algorithms for real-time DSP',1995, Prentice Hall PTR, pp. 98-113, 134-137,228-233, 147, no month.*

(Continued)

*Primary Examiner*—Daniel Swerdlow
(74) *Attorney, Agent, or Firm*—Schwegman, Lundberg, & Woessner, P.A.

(57) ABSTRACT

A hearing assistance system having adjustable bulk delay for cancellation of a time varying acoustic feedback path. The hearing assistance system including an FIR filter, coefficient update module, and delay rules module for programmable adaptive filtering. The hearing assistance system adjustable for continuous bulk delay adjustments. The hearing assistance system providing a number of coefficient update routines, including, but not limited to an LMS coefficient update process and a normalized LMS coefficient update process.

23 Claims, 4 Drawing Sheets

U.S. PATENT DOCUMENTS

| | | | | |
|---|---|---|---|---|
| 4,508,940 | A | 4/1985 | Steeger | |
| 4,548,082 | A | 10/1985 | Engebretson et al. | |
| 4,582,963 | A * | 4/1986 | Danstrom | 379/406.08 |
| 4,589,137 | A | 5/1986 | Miller | |
| 4,596,902 | A | 6/1986 | Gilman | |
| 4,622,440 | A | 11/1986 | Slavin | |
| 4,628,529 | A | 12/1986 | Borth et al. | |
| 4,630,305 | A | 12/1986 | Borth et al. | |
| 4,658,426 | A | 4/1987 | Chabries et al. | |
| 4,680,798 | A | 7/1987 | Neumann | |
| 4,731,850 | A | 3/1988 | Levitt et al. | |
| 4,751,738 | A | 6/1988 | Widrow et al. | |
| 4,771,396 | A | 9/1988 | South et al. | |
| 4,783,818 | A | 11/1988 | Graupe et al. | |
| 4,791,672 | A | 12/1988 | Nunley et al. | |
| 4,823,382 | A * | 4/1989 | Martinez | 379/406.08 |
| 4,879,749 | A | 11/1989 | Levitt et al. | |
| 5,259,033 | A * | 11/1993 | Goodings et al. | 381/318 |
| 5,737,410 | A * | 4/1998 | Vahatalo et al. | 379/406.08 |
| 5,920,548 | A * | 7/1999 | El Malki | 370/291 |
| 6,219,427 | B1 | 4/2001 | Kates et al. | 381/318 |
| 6,498,858 | B2 | 12/2002 | Kates | 381/318 |
| 6,876,751 | B1 * | 4/2005 | Gao et al. | 381/318 |
| 6,928,160 | B2 * | 8/2005 | Ebenezer et al. | 379/406.06 |
| 7,058,182 | B2 * | 6/2006 | Kates | 381/312 |
| 2001/0002930 | A1 | 6/2001 | Kates | 381/317 |
| 2002/0176584 | A1 | 11/2002 | Kates | 381/60 |

OTHER PUBLICATIONS

Saeed V. Vaseghi, Advanced Digital Signal Processing and Noise Reduction, Second Edition,2000, John Wiley & Sons, pp. 397-404, no month.*

Paul Embree, 'C++ Algorithms for Digital Signal Processing', 1999,Prentice Hall PTR, pp. 313-320, no month.*

Widrow, B , et al., "Stationary and nonstationary learning characteristics of the LMS adaptive filter", *Proceedings of the IEEE*, 64(8), (Aug. 1976), pp. 1151-1162.

Anderson, D. B., "Noise Reduction in Speech Signals Using Pre-Whitening and the Leaky Weight Adaptive Line Enhancer", Project Report presented to the Department of Electrical Engineering, Brigham Young University, (Feb. 1981),56 pgs.

Best, L. C., "Digital Suppression of Acoustic Feedback in Hearing Aids", *Thesis, Department of Electrical Engineering and The Graduate School of the University of Wyoming*, (May 1985), 66 pgs.

Boll, S. F., "Suppression of Acoustic Noise in Speech Using Spectral Subtraction", *IEEE Transactions on Acoustics, Speech, and Signal Processing*, vol. ASSP-27, (Apr. 1979), 113-120.

Bustamante, D. K., et al., "Measurement and Adaptive Suppression of Acoustic Feedback in Hearing Aids", *1989 International Conference on Acoustics, Speech, and Signal Processing, 1989. ICASSP-89.*, (1989), 2017-2020.

Chabries, D. M., et al., "A General Frequency-Domain LMS Adaptive Algorithm", *IEEE Transactions on Acoustics, Speech, and Signal Processing*, (Aug. 1984), 6 pgs.

Chazan, D., et al., "Noise Cancellation for Hearing Aids", *IEEE International Conference on ICASSP '86. Acoustics, Speech, and Signal Processing.*, OTI 000251-255, (Apr. 1986), 977-980.

Christiansen, R. W., "A Frequency Domain Digital Hearing Aid", *1986 IEEE ASSP Workshop on Applications of Signal Processing to Audio and Acoustics, IEEE Acoustics, Speech, and Signal Processing Society*, (1986),4 pgs.

Christiansen, R.W., et al., "Noise Reduction in Speech Using Adaptive Filtering I: Signal Processing Algorithms", *Proceedings, 103rd Conference of Acoustical Society of America*, (Apr. 1982),7 pgs.

Egolf, D.P., et al., "The Hearing Aid Feedback Path: Mathematical Simulations and Experimental Verification", *J. Acoust. Soc. Am.*, 78(5), (1985), 1576-1587.

Levitt, H., "A Cancellation Technique for the Amplitude and Phase Calibration of Hearing Aids and Nonconventional Transducers", *Journal of Rehabilitation Research*, 24(4), (1987), 261-270.

Levitt, H., et al., "A Digital Master Hearing Aid", *Journal of Rehabilitation Research and Development*, 23(1), (1986),79-87.

Levitt, H. , et al., "A Historical Perspective on Digital Hearing Aids: How Digital Technology Has Changed Modern Hearing Aids", *Trends in Amplification*, 11(1), (Mar. 2007),7-24.

Mcaulay, R., et al., "Speech enhancement using a soft-decision noise suppression filter", *IEEE Transactions on Acoustics, Speech, and Signal Processing*[see also IEEE Transactions on Signal Processing], 28(2), (Apr. 1980), 137-145.

Preves, D. A., "Evaluation of Phase Compensation for Enhancing The Signal Processing Capabilities of Hearing Aids in Situ", *Thesis, Graduate School of the University of Minnesota*, (Oct. 1985), 203 pgs.

Rosenberger, J. R., et al., "Performance of an Adaptive Echo Canceller Operating in a Noisy, Linear, Time-Invariant Environment", *The Bell System Technical Journal*, 50(3), (1971), 785-813.

South, C. R., et al., "Adaptive Filters to Improve Loudspeaker Telephone", *Electronics Letters*,15(21), (1979), 673-674.

Weaver, K. A., "An Adaptive Open-Loop Estimator for the Reduction of Acoustic Feedback", *Thesis, Department of Electrical Engineering and The Graduate School of the University of Wyoming*, (Dec. 1984), 70 pgs.

Weaver, K. A., et al., "Electronic Cancellation of Acoustic Feedback to Increase Hearing-Aid Stability", *The Journal of the Acoustical Society of America*, vol. 77, Issue S1, (109th Meeting, Acoustical Society of America),(Abstract Only), (Apr. 1985), p. S105.

Widrow, B., et al., "Adaptive Antenna Systems", *Proceedings of the IEEE*, 55(12), (Dec. 1967),2143-2159.

Widrow, B. , et al., "Adaptive Noise Cancelling: Principles and Applications", *Proceedings of the IEEE*, 63(12), (1975),1692-1716.

Wreschner, M. S., et al., "A Microprocessor Based System for Adaptive Hearing Aids", *1985 ASEE Annual Conference Proceedings*, (1985), 688-691.

* cited by examiner

METHOD AND APPARATUS FOR A HEARING ASSISTANCE SYSTEM WITH ADAPTIVE BULK DELAY

FIELD OF THE INVENTION

The present subject matter relates to hearing assistance systems having digital signal processing.

BACKGROUND

Hearing aids are prone to acoustic feedback problems since any time a microphone can receive output from a sound emitter, such as a receiver (also known as a speaker), the system can resonate at a feedback frequency. Workers in the hearing assistance area have worked on this problem for years with varying degrees of success.

One problem associated with hearing aids is that the cancellation algorithms used are frequently very system-dependent and are typically calibrated infrequently to minimize setup problems. Such devices may not adapt to changes in the use of the device, such as a user placing a telephone to his ear or a change in position of the hearing aid.

What is needed in the art is an acoustic feedback cancellation system which provides ongoing cancellation with a minimal loss of signal quality for the user. The system should be adaptable to a number of time varying acoustic feedback conditions.

SUMMARY

The present hearing assistance system provides solutions for the foregoing problems and for others not mentioned expressly herein. The present hearing assistance system employs a negative feedback loop that provides an acoustic feedback estimate to approximate a time-varying acoustic feedback from the receiver to the microphone and the acoustic feedback estimate includes an adaptive bulk delay that adjusts to compensate for changes in the acoustic feedback. The present system is adapted for updating the estimated bulk delay based on changes in the acoustic feedback path. A number of adaptive filter coefficient update processes are available. The system can be adjusted to position higher power filter coefficients in different filter tap locations to provide a better acoustic feedback estimate and produce a better replica of the desired input sound.

The present system finds filter coefficients which are approximately centered by continuous adjustment of adaptive bulk delay. In one embodiment an N tap filter implementation is employed wherein the M consecutive and most significant filter coefficients are moved to a central position of the filter coefficients by adjustment of bulk delay.

The present system is realizable in a variety of implementations including hardware, software, and firmware implementations and combinations thereof.

The present system has applications in hearing assistance systems which include, but are not limited to hearing aids.

Other embodiments are provided in the specification and claims, which are not herein summarized.

This Summary is an overview of some of the teachings of the present application and not intended to be an exclusive or exhaustive treatment of the present subject matter. Further details about the present subject matter are found in the detailed description and appended claims. Other aspects will be apparent to persons skilled in the art upon reading and understanding the following detailed description and viewing the drawings that form a part thereof, each of which are not to be taken in a limiting sense. The scope of the present invention is defined by the appended claims and their legal equivalents.

BRIEF DESCRIPTION OF THE DRAWINGS

Various embodiments are illustrated by way of example and not by way of limitation in the figures of the accompanying drawings in which like references indicate similar elements.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. It will be apparent, however, to one skilled in the art that the various embodiments may be practiced without some of these specific details. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Figure 1:
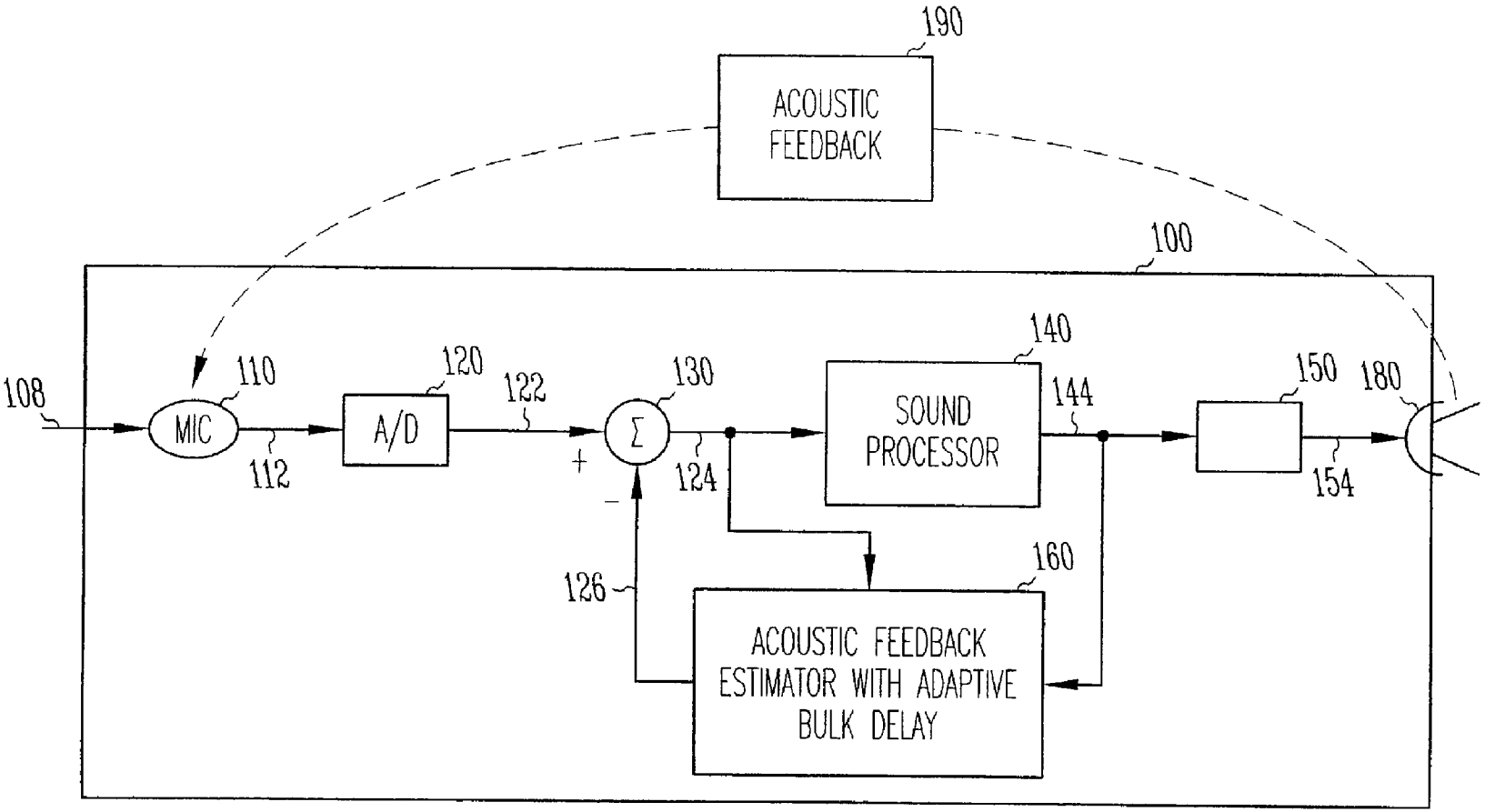
FIG. 1 shows a functional block diagram of a hearing assistance system according to one embodiment of the present subject matter and a representation of an acoustic feedback path.

FIG. 1 shows a functional block diagram of a hearing assistance system according to one embodiment of the present invention and a representation of an acoustic feedback path. The hearing assistance system 100 includes a microphone 110, which receives input sound 108 and provides a signal 112 to an analog-to-digital converter 120. A digital representation 122 of the signal 112 is provided to the summer 130. The summer 130, sound processor 140 and acoustic feedback estimator with adaptive bulk delay 160 are configured in a negative feedback configuration to provide a cancellation of the acoustic feedback 190. In FIG. 1, the input sound 108 is desired signal and conceptually separate from acoustic feedback 190. In providing the cancellation, signal 124 represents a form of error signal to assist in producing the acoustic feedback estimate 126 from acoustic feedback estimator with adaptive bulk delay 160. While not critical to the bulk delay and acoustic feedback estimate aspects of the system, sound processor 140 can be implemented to provide a number of signal processing tasks, at least some of which are found in hearing assistance systems. The resulting processed digital output 144 is received by driver 150 and used to drive receiver 180. In one embodiment, driver 150 is a digital to analog converter and amplifier combination to drive receiver 180. In one embodiment, driver 150 is a direct drive. In one embodiment, driver 150 is a pulse width modulator. In one embodiment, driver 150 is a pulse density modulator. Receiver 180 also can vary. In one embodiment, receiver 180 is a speaker. In on embodiment, receiver 180 is a transducer. Other drivers and receivers may be used without departing from the scope of the present subject matter.

Digital output 144 is provided to the acoustic feedback estimator with adaptive bulk delay 160 to create the acoustic feedback estimate 126. Summer 130 subtracts acoustic feedback estimate 126 from digital representation 122 to create error signal 124.

It is understood that various amplifier stages, filtering stages, and other signal processing stages are combinable with the present teachings without departing from the scope of the present subject matter.

The sound cancellation is necessary since acoustic output from the receiver 180 invariably couples with the microphone 110 through a variety of possible signal paths. Some example acoustic feedback paths may include air paths between the receiver 180 and microphone 110, sound conduction paths via the enclosure of hearing assistance system 100, and sound conduction paths within the enclosure of hearing assistance system 100. Such coupling paths are collectively shown as acoustic feedback 190.

Thus, if properly implemented the feedback system of FIG. 1 will produce an acoustic feedback estimate 126 which is closely modeled after acoustic feedback 190. Thus, summer 130 will subtract the acoustic feedback estimate 126 from signal 122, thereby cancelling the effect of acoustic feedback 190 in signal 124. As the cancellation becomes ideal signal 124 approaches signal 122, which is a digital representation of input sound 108. It is noted that signal 124 is called an error signal only because it represents error to the closed loop system, that is when it departs from signal 122 that is error. When working properly, the information on error signal 124 is the desired sound information from input sound 108. Thus, the "error" nomenclature does not mean that the signal is purely error, but rather that its departure from the desired signal indicates error in the closed loop feedback system.

Figure 2:
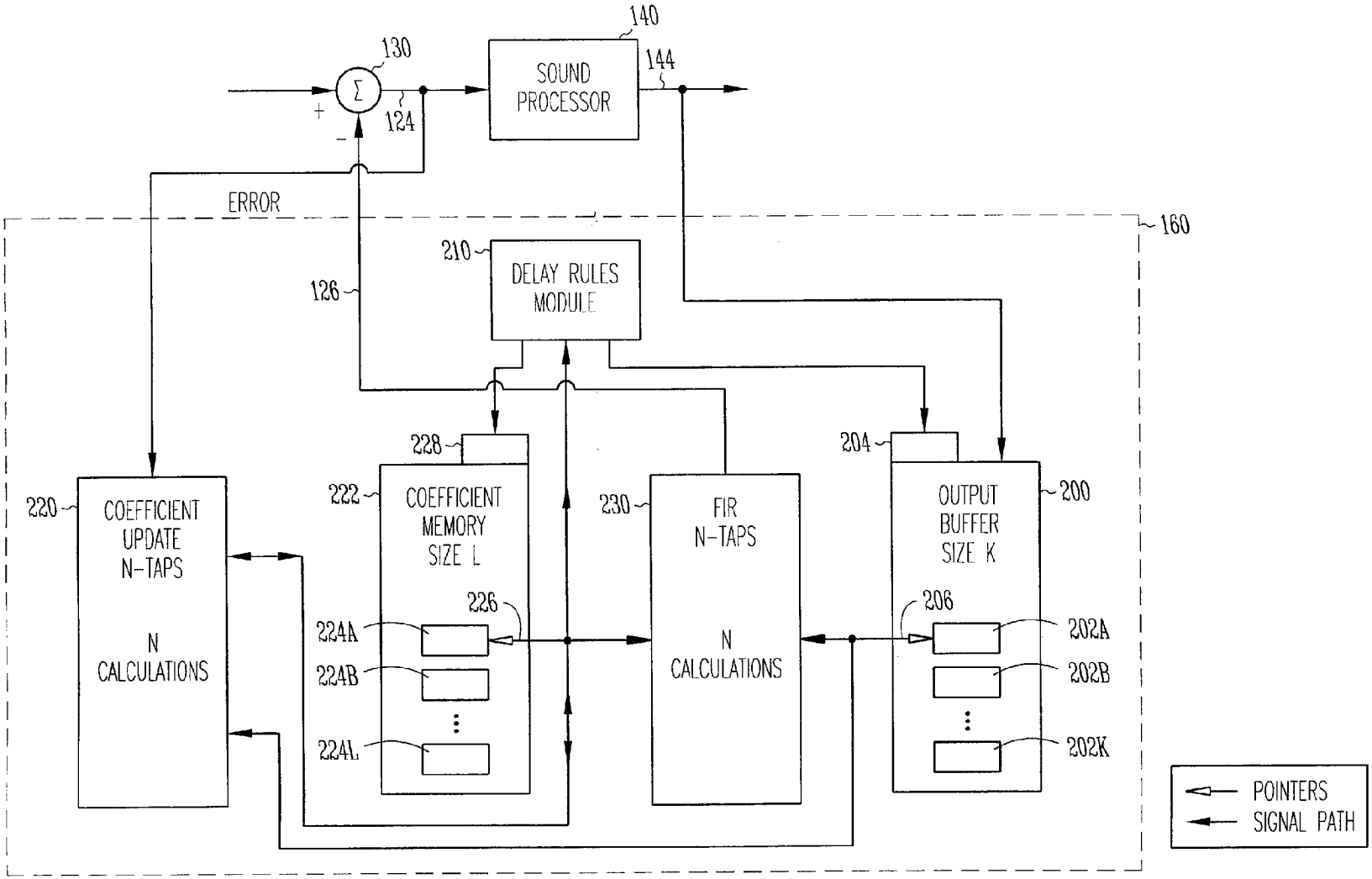
FIG. 2 shows functional block diagram details of the hearing assistance system of FIG. 1 according to one embodiment of the present subject matter.

FIG. 2 shows additional details of the hearing assistance system of FIG. 1 according to one embodiment of the present invention. FIG. 2 shows more detail of an acoustic feedback estimator with adaptive bulk delay 160, according to one embodiment of the present system. The error signal 124 is received by coefficient update module 220. Coefficient update module 220 implements any of a number of adaptive filter coefficient update processes, including, but not limited to, an RLS update process, an affine projection update process, an LMS update process, or any of a number of LMS based update processes. For instance, one example of an LMS update process is a normalized LMS update process. The coefficient update processes enumerated herein are not an exclusive or exhaustive list and other adaptive filters and coefficient update processes may be employed without departing from the scope of the present subject matter.

The coefficient update module 220 receives samples from memory 200. Memory 200 is an output buffer of suitable size for processing and operates in a first-in-first-out (FIFO) configuration taking digital samples from digital output 144. A pointer 206 is adjustable to shift the output of the memory 200 from one memory position to another. In this example, memory 200 is a buffer with K memory spaces 202*a*, 202*b*, . . . 202K. The pointer 206 allows different positions in the memory 200 to be the head of the FIFO buffer. The shift of pointer 206 is accomplished by a digital signal into shift input 204 from delay rules module 210. In one embodiment, the shift signal is a digital signal for shifting the pointer 206. In one embodiment the pointer is an address in memory 200 and the shift signal is some form of increment of that address to the next location. It is understood that such configurations may be performed using software, firmware and/or hardware and in combinations thereof. The configuration of the memory can be other than FIFO as long as logical data order is maintained. For example, in one embodiment a random access memory configuration is employed. In one embodiment, a linked list is employed. Other embodiments are possible that do not depart from the scope of the present subject matter.

In the embodiment of FIG. 2, FIR filter 230 is an N-tap finite impulse response filter that employs N coefficients from coefficient memory 222 and N samples from memory 200. A shift in the pointers in coefficient memory 222 and memory 200 provides the desired shift in bulk delay of the feedback system. The output 126 of FIR filter 230 is provided to summer 130, which is a negative input to the summer 130.

The coefficient memory 222 includes locations for coefficients of the FIR filter 230 which are received from the coefficient update module 220. In this example, coefficient memory 222 is a buffer with L memory spaces 224*a*, 224*b*, . . . 224L. The pointer 226 allows different positions in the memory to be the head of the buffer. The shift of pointer 226 is accomplished by a digital signal into shift input 228 from delay rules module 210. In one embodiment, the shift signal is a digital signal for shifting the pointer 226. In one embodiment the pointer 226 is an address in coefficient memory 222 and the shift signal is an increment of that address. In one embodiment, coefficient memory 222 is a FIFO configuration. In one embodiment, coefficient memory 222 is realized in random access memory. Other memory configurations are possible without departing from the scope of the present subject matter.

The delay rules module 210 receives coefficients from the coefficient update module 220 and provides signals to both the memory 200 and the coefficient memory 222 to change the position of the pointers 206 and 226. The bulk delay is adjusted by changing the position of pointer 206 in memory 200. In a preferred embodiment, adjustments to the pointer 206 in memory 200 are accompanied by like adjustments to the pointer 226 in coefficient memory 222. This provides a continuous transition in bulk delay and ensures that the coefficients applied to the samples in the FIR filter 230 are consistent with any shift in bulk delay. The delay rules module 210 performs adjustments to the bulk delay based on a methodology which keeps higher energy filter taps approximately centered in the coefficient space of the FIR filter 230, as demonstrated by one example in FIG. 3.

In the embodiment shown in FIG. 2, the N taps sent to the coefficient update module 220 match the N taps sent to the FIR filter 230, but it is noted that coefficient memory 222 includes L locations for storage of coefficient values to accommodate shifts of the coefficient space. Memory 200 includes K locations which provide ample buffering for the input samples and enough storage to accommodate processing delays in the system and shifts in the coefficient space.

Figure 3:
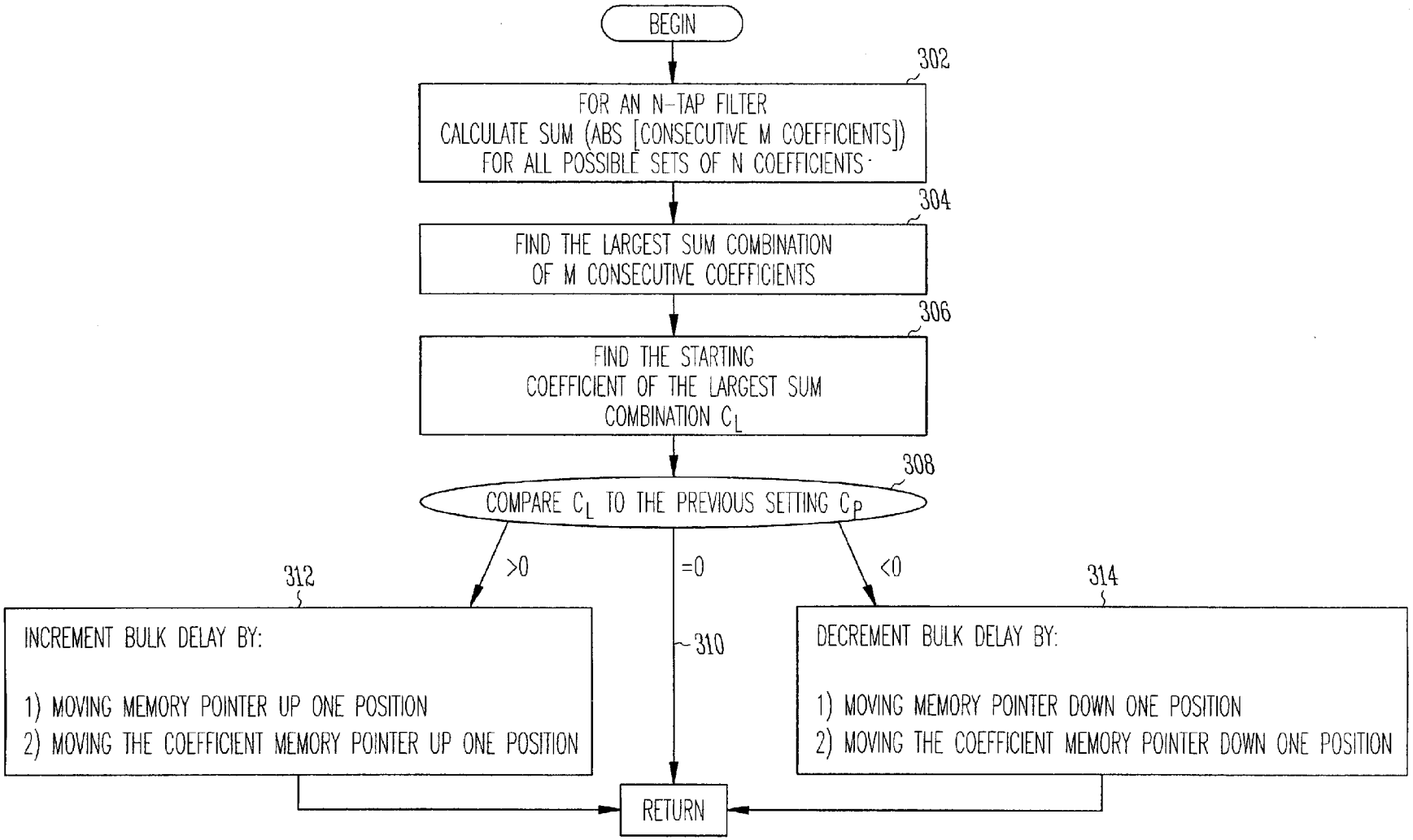
FIG. 3 shows a flow chart providing details of a process for adjusting bulk delay according to one embodiment of the present subject matter.

FIG. 3 shows a flow chart providing details of a process for adjusting bulk delay according to one embodiment of the present invention. In this embodiment, the flow begins by calculating a sum of the absolute value of the N coefficients for different permutations of the M consecutive coefficients (302). Thus, there are (N−M+1) different groups of M consecutive coefficients. For example, if N is ten (10) coefficients and M is for example six (6) coefficients, there are N−M+1 or five (5) permutations of six (6) consecutive coefficients: the six (6) consecutive coefficients beginning at the first, second, third, fourth, and fifth coefficient places. So for our example the process would calculate the absolute value of the sum of the coefficients for each of these five (5) permutations. The largest sum of the different combinations of M coefficients is then determined (304). (In our example, the largest sum would be identified from the five different groups of six coefficients.) The starting coefficient position of the largest sum combination is determined $C_L$ (306). The starting coefficient position $C_L$ of this iteration is compared to that of the previous iteration (308) (or the starting coefficient in the case that this is the first iteration of the loop). If the present coefficient position is unchanged from the previous position, then the loop does not adjust bulk delay (310) and the process repeats. If the present coefficient position $C_L$ is greater than the previous position, then the bulk delay is incremented one position by moving the pointer 206 of memory 200 up one position and shifting the pointer 226 of the coefficient memory 222 up one position (312). If the present coefficient position $C_L$ is less than the previous position, then the bulk delay is decremented one position by moving the pointer 206 of memory 200 down one position and shifting the pointer 226 of the coefficient memory 222 down one position (314).

The adaptive bulk delay process is programmable and can be repeated in a variety of ways. In one embodiment, the repetition rate is periodic. In one embodiment, the repetition is event driven. In one embodiment, the repetition is not according to a particular period. In one embodiment, a repetition delay of between about 10 to about 250 milliseconds is employed. In one embodiment an average repetition delays of about 50 milliseconds is used. In some environments updating may need to be relatively frequent, depending on changes to the acoustic feedback path. In some applications, such as when a user uses a telephone against his hearing aid, the loop can change somewhat slower. The delays provided herein are intended in a demonstrative sense and not intended to be exclusive or exhaustive. Repetitition delays/rates and the regularity of them may vary without departing from the scope of the present subject matter.

In various embodiments the delay rules process may change without departing from the scope of the present subject matter. For instance, in one embodiment, one or more pointers are shifted a plurality of coefficient positions when a current $C_L$ differs from a previous $C_L$. The amount of pointer shift may vary depending on whether the location $C_L$ is greater or lesser than its previous position. For instance, the loop may be programmed to shift upward two positions, but shift downward only one at a time. Other variables may be employed to determine the amount of coefficient position shift without departing from the teachings of the present subject matter.

In one embodiment, the adaptive bulk delay process is initiated with a nominal bulk delay for the first iteration of the process. Other approaches may be used to initiate the process without departing from the scope of the present subject matter.

Figure 4:
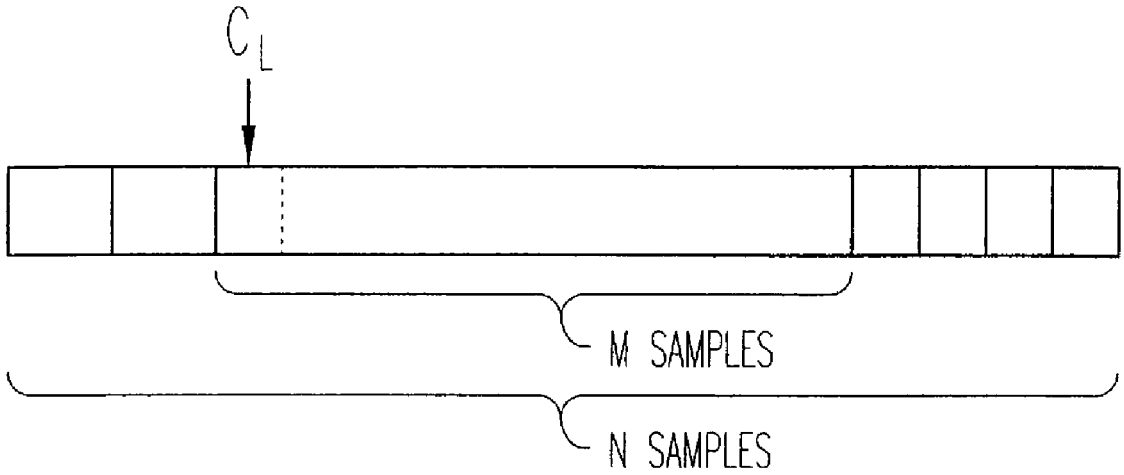
FIG. 4 shows examples of filter coefficient assignment according to one embodiment of the present subject matter.

FIG. 4 shows examples of filter coefficient position assignment and placement in the array of available filter coefficient positions according to one embodiment of the present system. The actual location of the M coefficients can vary. In one embodiment, a group of M consecutive coefficients are not perfectly centered, but positioned such that the first coefficient position of the M consecutive coefficients, $C_L$, is located one or more coefficient spaces into the filter buffer. Different positioning of the M consecutive coefficients can be established by testing different positions in the filter coefficient space of the M consecutive high powered coefficients and may depend on sample rate and particularities of the acoustic feedback environment of an application.

One embodiment of the delay rules module includes a peak detector for detecting a coefficient of maximal power. In one embodiment, the coefficients are being compared rather than an absolute value of the sum.

One embodiment of a hearing assistance system includes, but is not limited to a digital hearing aid. In the hearing aid application, sound processor 140 includes signal processing found in hearing aids. The present system provides ongoing improvement of adaptive bulk delay for a variety of hearing aid applications and environments. For instance, adjustment of bulk delay improves feedback canceller performance after a hearing aid changes position in the user's ear, because a change in position also changes the acoustic feedback path of the hearing aid. Also, the hearing aid acoustic feedback path may change when a user places a telephone against his or her ear or when a hat is placed or removed on the user's head. Other factors changing the acoustic feedback path may be encountered and the present system provides a way of adapting to such changes while the hearing aid user is using his or her hearing aid. The present system does not require a special step of re-initializing the hearing aid or another setup procedure to correct for changes in the acoustic feedback path. Other hearing assistance systems may employ the present subject matter without departing from the scope of the present disclosure.

The adaptive filter processes described herein are intended to demonstrate some ways of applying the adaptive bulk delay system set forth and other adaptive filter processes and implementations are possible without departing from the scope of the present subject matter. Although FIR filter examples are demonstrated herein, the adaptive bulk delay process will work with other filter designs, including, but not limited to infinite impulse response (IIR) filters. Thus, the examples herein are not intended in a limiting or exhaustive sense.

Among other things, the present system provides an improved method and apparatus for adapting bulk delay as the method for updating the coefficients is not restricted to an initialization procedure and does not require a special measurement mode. In varying embodiments, the update loop is programmable for varying applications. In various embodiments, the present system provides a real time update of bulk delay for a hearing assistance system.

It is understood that embodiments are provided herein which include sound processor 140, however, the adaptive bulk delay provided herein does not require any particular sound processor 140. If sound processor 140 were removed, effectively making signal 124 equal to signal 144, then the adaptive bulk delay described herein would operate on the unprocessed signal to produce an acoustic feedback estimate with adaptive bulk delay, as provided herein.

It is understood that the embodiments provided herein may be implemented in hardware, software, firmware, and combinations thereof. It is understood that hybrid implementations may be employed which change the signal flows and data processing without departing from the scope of the present application. Furthermore, the number of memory locations and positioning of coefficients can be changed without departing from the scope of the present teachings.

Although specific embodiments have been illustrated and described herein, it will be appreciated by those of ordinary skill in the art that any arrangement which is calculated to achieve the same purpose may be substituted for the specific embodiment shown. This application is intended to cover adaptations or variations of the present subject matter. It is to be understood that the above description is intended to be illustrative, and not restrictive. Combinations of the above embodiments, and other embodiments will be apparent to those of skill in the art upon reviewing the above description. The scope of the present subject matter should be determined with reference to the appended claims, along with the full scope of equivalents to which such claims are entitled.

What is claimed is:

1. An apparatus, comprising:

a microphone;

an analog-to-digital converter that receives analog signals from the microphone and converts the analog signals into a digital representation;

a summer that receives the digital representation and subtracts an acoustic feedback estimate to create an error signal;

a driver that receives a digital signal at least partially derived from the error signal and drives a receiver; and an acoustic feedback estimator with an adaptive bulk delay that receives the digital signal and the error signal, wherein the acoustic feedback estimate is an approximation of a time-varying acoustic feedback from the receiver to the microphone and the acoustic feedback estimate includes the adaptive bulk delay that adjusts during use to compensate for changes in the time-varying acoustic feedback.

2. The apparatus of claim 1, further comprising a sound processor that receives the error signal and produces a digital output, wherein the digital signal is the digital output.

3. The apparatus of claim 2, further comprising:

a memory that receives the digital output and includes a plurality of memory locations for storing a plurality of digital samples and a pointer for pointing to certain digital samples;

a coefficient update module that receives the error signal and the digital samples and generates new filter coefficients;

a coefficient memory that stores the new filter coefficients and includes a coefficient pointer for pointing to certain new filter coefficients;

a filter that receives a delayed version of the digital output from the memory and the new filter coefficients; and a delay rules module providing outputs for controlling the pointer of the memory and the coefficient pointer of the coefficient memory based on the new filter coefficients to adjust the adaptive bulk delay.

4. The apparatus of claim 3, wherein the delay rules module includes storage for a number of consecutive coefficients and for a first coefficient position.

5. The apparatus of claim 4, wherein the memory is a first-in-first-out (FIFO) data buffer.

6. The apparatus of claim 4, wherein the apparatus is realized in a mix of hardware, firmware and software.

7. The apparatus of claim 4, wherein the apparatus is realized substantially in hardware.

8. The apparatus of claim 4, wherein the apparatus is realized substantially in software.

9. The apparatus of claim 4, wherein the coefficient update module is adapted for implementing an LMS coefficient update process.

10. The apparatus of claim 4, wherein the coefficient update module is adapted for implementing a normalized LMS coefficient update process.

11. The apparatus of claim 4 wherein the filter is an FIR filter.

12. The apparatus of claim 4, wherein the filter is an IIR filter.

13. A method, comprising:

receiving a sound signal;

converting the sound signal to a series of digital samples;

estimating an acoustic feedback to produce an estimated acoustic feedback signal;

adaptively adjusting a bulk delay to compensate for changes in the acoustic feedback signal;

generating a processed sound signal by processing the digital samples, including subtracting the estimated feedback signal incorporating the bulk delay; and converting the processed sound signal into sounds, wherein the adaptively adjusting is repeated during operation to correct the estimated acoustic feedback signal.

14. The method of claim 13, wherein the bulk delay is set to an initial value.

15. The method of claim 14, wherein the adaptively adjusting comprises:

finding a number of largest consecutive filter coefficients M, of an N tap filter;

finding a starting location of the M largest consecutive filter coefficients;

comparing the starting location with a previous starting location to produce an offset;

updating the N tap filter to position the M largest consecutive filter coefficients using the offset; and processing digital samples based on the updated filter.

16. The method of claim 15, wherein the updating comprises using a second offset with the first offset to relocate the M largest consecutive filter coefficients.

17. A method, comprising:

storing a plurality of filter coefficients from a coefficient update module;

storing a plurality of digital samples in a feedback system;

applying the filter coefficients to the digital samples according to delay rules; and updating an adjustable adaptive bulk delay in a hearing assistance device to provide cancellation of time varying acoustic feedback.

18. The method of claim 17, wherein the updating is repeated approximately 50 milliseconds.

19. The method of claim 17, wherein the updating is repeated between 10 to 250 milliseconds.

20. The method of claim 17, wherein the plurality of filter coefficients are FIR filter coefficients.

21. The method of claim 17, wherein the plurality of filter coefficients are IIR filter coefficients.

22. A method, comprising:

receiving a sound signal;

converting the sound signal to a series of digital samples;

estimating an acoustic feedback to produce an estimated acoustic feedback signal;

adjusting a bulk delay to compensate for changes in the acoustic feedback signal; and generating a processed sound signal by processing the digital samples, including subtracting the estimated feedback signal incorporating the bulk delay;

converting the processed sound signal into sounds, wherein the adjusting is repeated during operation to correct the estimated acoustic feedback signal; wherein the bulk delay is set to an initial value; and wherein the adjusting comprises:

finding a number of largest consecutive filter coefficients M, of an N tap filter;

finding a starting location of the M largest consecutive filter coefficients;

comparing the starting location with a previous starting location to produce an offset;

updating the N tap filter to position the M largest consecutive filter coefficients using the offset; and processing digital samples based on the updated filter.

23. The method of claim 22, wherein the updating comprises using a second offset with the first offset to relocate the M largest consecutive filter coefficients.

* * * * *